US005186665A

United States Patent [19]

Kelly et al.

[11] Patent Number: 5,186,665

[45] Date of Patent: Feb. 16, 1993

[54] ELECTRICAL TERMINAL

[75] Inventors: Steven C. Kelly, Cortland; Daniel H. Huff, Austintown; William G. Strang, Warren, all of Ohio

[73] Assignee: General Motors Corporation, Detroit, Mich.

[21] Appl. No.: 884,090

[22] Filed: May 15, 1992

[51] Int. Cl.[5] ..... H01R 13/00

[52] U.S. Cl. ..... 439/862

[58] Field of Search ..... 439/629-637, 439/816, 824, 862

[56] References Cited

U.S. PATENT DOCUMENTS

| | | | |
|---|---|---|---|
| 3,299,396 | 1/1967 | Kinkaid | 439/862 |
| 4,433,888 | 2/1984 | Winger | 339/91 R |
| 4,720,274 | 1/1988 | Tacket et al. | 439/862 |
| 5,087,213 | 2/1992 | Drapcho et al. | 439/672 |
| 5,090,925 | 2/1992 | Sato et al. | 439/862 |

*Primary Examiner*—Joseph H. McGlynn
*Attorney, Agent, or Firm*—William A. Schuetz

[57] ABSTRACT

An electrical terminal for making butt contact with a dome shaped contact of an electrical device comprises an elongated base plate that has a contact support at a forward end that is integrally attached to a longitudinal side of the elongated base. A resilient contact tongue is integrally attached to the contact support and extends rearwardly over the elongated base plate in cantilever fashion. The contact tongue is bow shaped in the longitudinal direction and has a curved mid span or apex portion that is arcuate in cross section for butt engaging a dome shaped contact of an electrical device.

6 Claims, 2 Drawing Sheets

ELECTRICAL TERMINAL

BACKGROUND OF THE INVENTION

This invention relates generally to electrical terminals and more specifically to electrical terminals having a resilient cantilevered contact section or tongue for engaging a contact of an electrical device such as a lamp bulb U.S. Pat. No. 5,087,213 issued to James M. Drapcho et al Feb. 11, 1992 and assigned to General Motors Corporation discloses a lamp socket having feed terminals 88, 90. Each feed terminal comprises an elongated narrow base plate 96 integrally formed with a pair of laterally spaced upstanding side walls 98 and 100. A resilient cantilevered contact section 102 or tongue is reversely bent from a free end of the base plate 96 and terminates with a foot 104 which engages the base plate adjacent longitudinally spaced pairs of crimp wings 106, 110. The crimp wings 106 are attached to the stripped conductor core end of a feed cable 108 while crimp wings 110 clamp a cable seal 112 having ring type sealing ribs to the insulation jacket of the feed cable 108.

These feed terminals have a major drawback associated with the manner in which the resilient cantilevered contact tongue 102 is provided by being reversely bent from the free end of the base plate 96. This design configuration requires an extremely long blank strip for forming the feed terminal and results in considerable scrap when the feed terminal is stamped out of the blank strip. Another drawback of the contact section is that the curved mid span of apex portion of the contact tongue that engages the solder bead contact of the lamp bulb 14 is flat in cross section. This flat cross section produces low contact forces because it yields as the lamp bulb is seated in the lamp socket. The flat cross section also makes it difficult to seat the lamp bulb properly as it is rotated into position because the solder bead contacts of the lamp bulb scrape on the sharp edges of the flat cross section.

U.S. Pat. No. 4,433,888 issued to James L. Winger Feb. 28, 1984 discloses a printed circuit edgeboard connector having terminals 16 that comprise a resilient contact tongue 45 that is attached to the free end of a base plate by a perpendicular tab that is integrally attached to the respective longitudinal edges of the base plate and the contact tongue. This reduces the length of the blank strip that is needed to form the terminal substantially and likewise reduces the scrap. However, the resilient contact tongue still has a flat cross section and thus produces low contact forces. Moreover the resilient contact tongue is not suitably configured for use in a lamp bulb socket and in this regard is even less desirable than the resilient contact tongue of the Drapcho terminal discussed above Another drawback of the Winger terminal is that the open front end of the terminal and the high position of the contact tongue provide excellent possibilities for the terminals tangling with each other during handling and assembly particularly after the terminals are attached to electric cables which are then handled in large bundles.

SUMMARY OF THE INVENTION

The object of this invention is to provide an improved electrical terminal of the type having a resilient contact tongue for engaging a contact of an electrical device such as a lamp bulb for use as a feed terminal in a lamp socket or the like.

A feature of the invention is that the electrical terminal has a resilient cantilevered contact tongue that has an improved shape that reduces contact forces for butt engaging a solder or dome shaped contact of an electrical device, such as a lamp bulb.

Another feature of the invention is that the electrical terminal has a resilient cantilevered contact tongue that has an improved shape for use as a feed terminal in a lamp socket where the lamp bulb is seated by rotating the lamp bulb into a locked position.

Another feature of the invention is that the electrical terminal has a cantilevered contact tongue that has a curved mid span or apex portion for butt engaging a solder or dome shaped contact that is arcuate in cross section for increasing contact forces and for facilitating seating of a lamp bulb when the electrical terminal is used as a feed terminal in a lamp socket.

Still another feature of the invention is that the electrical terminal has a resilient cantilevered contact tongue of varying arched cross section that decreases in curvature from a central apex and transitions to longitudinally spaced flat cross sections adjacent opposite ends of the resilient cantilevered contact tongue.

Yet another feature of the invention is that the resilient cantilevered contact tongue is attached to the base plate by a perpendicular tab that forms part of a closed box at the front end of the terminal that reduces the tendency of the electrical terminals to tangle with each other during handling and assembly Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 2:
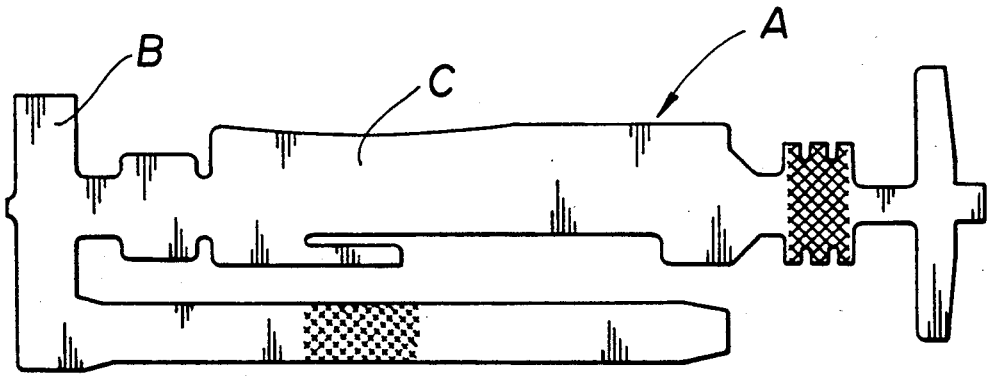
FIG. 2 is a plan view of a blank for making the electrical terminal that is shown in FIG. 1.

Referring now to the drawing, an electrical terminal 10 of this invention is illustrated attached to an electric cable 12. The terminal 10 is stamped and bent from a sheet metal blank A, preferably of stainless steel, that is illustrated in FIG. 2.

Figure 1:
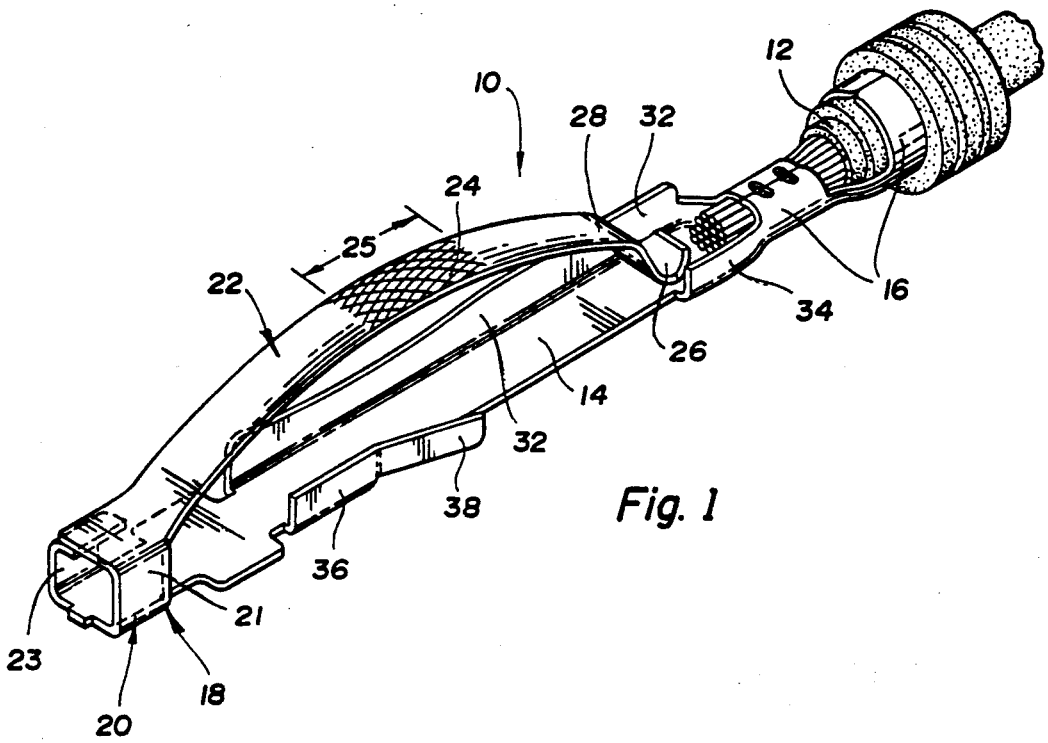
FIG. 1 is a perspective view of an electrical terminal in accordance with our invention.
Figure 3:
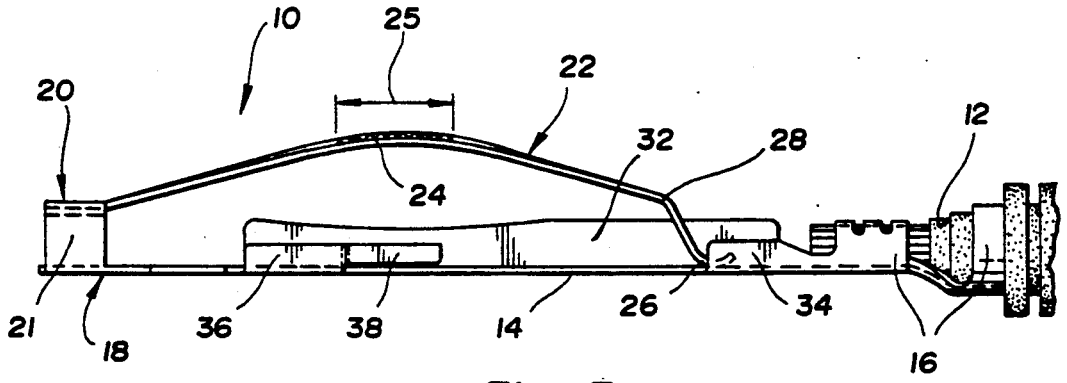
FIG. 3 is a side view of the terminal that is shown in FIG. 1.
Figure 4:
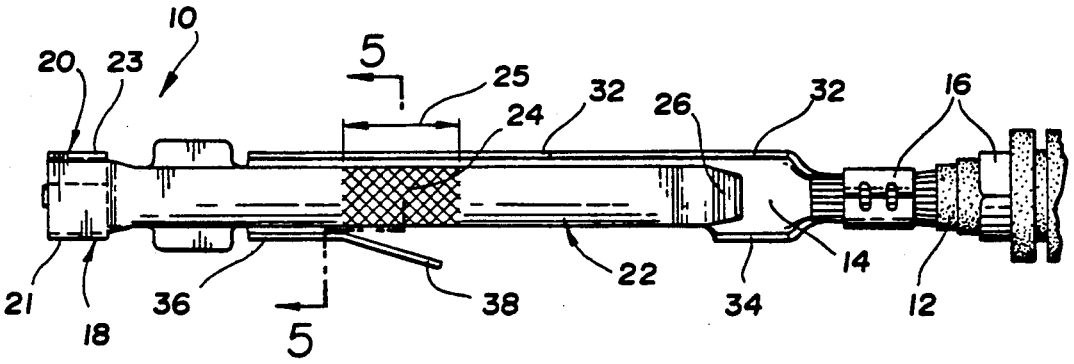
FIG. 4 is a top view of the terminal that is shown in FIG. 1.

The electrical terminal 10 comprises an elongated base plate 14 that has conventional core and insulation crimp wings 16 at one end and a contact support 18 at the opposite end. The core and insulation crimp wings 16 are crimped around the stripped conductor core end and a cable seal on an adjacent end of the insulation jacket of the electrical cable 12 in a conventional manner as illustrated in FIGS. 1, 3 and 4.

The support 18 is a closed, four sided box 20 that is folded from a cross strip B at the front end of the blank body C. A resilient contact tongue 22 is integrally attached to the base plate 14 by a perpendicular tab 21 that is integrally attached to the longitudinal edges of the tongue and the base plate respectively. The tab 21 forms one side of the box 20 while the front end of the tongue 22 forms the side of the box 20 that is opposite the front end of the base plate 14 so that the tongue 22 extends rearwardly over the base plate 14 in cantilever fashion as shown in FIGS. 1, 3 and 4.

A second perpendicular tab 23 which forms the fourth side of the box 20 is folded inwardly at the tab to firmly support the front end of the contact tongue 22.

The contact tongue 22 is bow shaped in the longitudinal direction and has an apex 24 midway between its ends. The free end of the contact tongue 2 has a rounded foot 26 that engages and slides along the base 14 when the contact tongue 22 is depressed.

Figure 5:
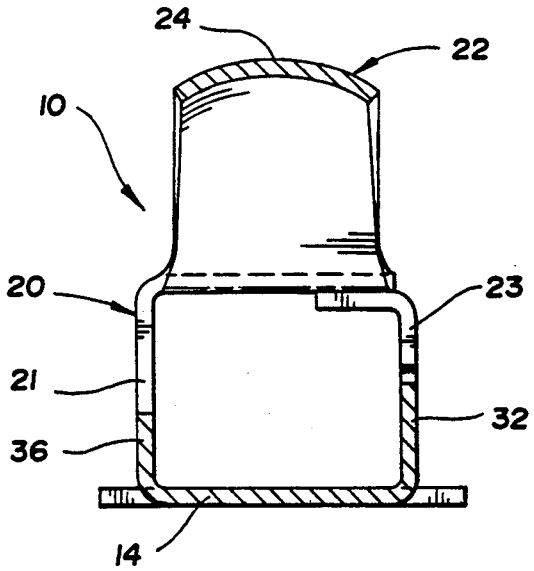
FIG. 5 is a cross section taken substantially along the line 5—5 of FIG. 4 looking in the direction of the arrows.

The curved mid span or apex portion 25 enveloping the apex 24 butt engages the solder or dome shaped contact of an electrical device, such as a lamp bulb and this portion is preferably knurled as shown in the drawings. The apex 24 is arcuate in cross section as shown in FIG. 5. The arcuate cross section of the contact tongue 22 varies along the contact tongue and decreases in curvature from the apex 24 and transitions to longitudinally spaced flat cross sections 28 adjacent opposite ends of the contact tongue 22. By way of example, we have found that a radius of curvature of about 3.75 mm for a contact tongue that is about 3.00 mm wide and about 33.0 mm long from front end to foot produces the desired improved results of better stress distribution and higher contact force. The arcuate cross section shape of the resilient contact tongue 22 described above distributes the stresses, reduces yielding and set, and retains terminal functioning for the required deflections when the contact tongue 22 is depressed by butt engagement with solder or dome shaped contact of the lamp bulb or other electrical device that it contacts Moreover, in a lamp socket application, the arcuate shape of the apex mid span portion 25 provides a lead in that prevents damage to the solder contacts when the lamp bulb is rotated into a locked position in the lamp socket.

The electrical terminal 10 further comprises an elongated side wall 32 that is integrally connected to one longitudinal side of the base plate 14. It also has a short side wall 34 integrally connected to the opposite longitudinal side of the base plate 14 near the crimp wings 16. The foot 26 at the free end of the contact tongue 22 is disposed between the side walls 32 and 34. This protects the free end of the contact tongue 22. The positioning of the free end of the contact tongue 22 between the side walls 32 and 34 in combination with the closed box 20 at the front end of the terminal 10 also makes the terminal 10 less susceptible to entanglements with other terminals during handling and assembly particularly when the terminals are attached to electric cables.

The electrical terminal 10 also includes a forward side wall portion 36 that supports a latch tang 38 that slats outwardly and rearwardly. The latch tang 38 locks the electrical terminal 10 in a terminal cavity of a lamp socket or insulator housing in a conventional manner.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical terminal for making butt contact with a dome shaped contact of an electrical device comprising:

an elongated base plate that has core and insulation crimp wings at one end and a contact support at the opposite end that is formed as a closed, four sided box at a front end of the terminal, and a resilient contact tongue that is integral with a side of the box that is opposite to the front end of the base plate so that the contact tongue extends rearwardly over the base plate in cantilever fashion, the contact tongue being bow shaped in the longitudinal direction and having a free end that engages and slides along the base plate when the contact tongue is depressed, and the contact tongue having an apex midway between its ends for butt engaging a solder or dome shaped contact of an electrical device, such as a lamp bulb that is arcuate in cross section

2. The electrical terminal as defined in claim 1 wherein the terminal has a side wall that is integrally connected to one longitudinal side of the base and another side wall that is integrally connected to an opposite longitudinal side of the base and the foot at the free end of the contact tongue is disposed between the side walls to protect the free end of the contact tongue and to make the terminal less susceptible to entanglements with other terminals in combination with the closed box at the front end of the terminal.

3. The electrical terminal as defined in claim wherein the contact tongue has an arcuate cross section that varies along the contact tongue and decreases in curvature from the apex and transitions to longitudinally spaced flat cross sections adjacent opposite ends of the contact tongue.

4. The electrical terminal as defined in claim 3 wherein the terminal has a side wall that is integrally connected to one longitudinal side of the base and another side wall that is integrally connected to an opposite longitudinal side of the base and the foot at the free end of the contact tongue is disposed between the side walls to protect the free end of the contact tongue and to make the terminal less susceptible to entanglements with other terminals in combination with the closed box at the front end of the terminal.

5. An electrical terminal for making butt contact with a dome shaped contact of an electrical device comprising:

an elongated base plate that has a contact support tab at a forward end that is integrally attached to a longitudinal side of the elongated base plate, and a resilient contact tongue that is integrally attached to the contact support tab so that the contact tongue extends rearwardly over the elongated base plate in cantilever fashion, the contact tongue being bow shaped in the longitudinal direction and having an apex midway between its ends that is arcuate in cross section for butt engaging a dome shaped contact of an electrical device.

6. The electrical terminal as defined in claim 5 wherein the contact tongue has an arcuate cross section that varies along the contact tongue and decreases in curvature from the apex and transitions to longitudinally spaced flat cross sections adjacent opposite ends of the contact tongue.

* * * * *